United States Patent [19]

Freedman

[11] Patent Number: 4,934,000

[45] Date of Patent: Jun. 19, 1990

[54] SHOWER HEAD

[76] Inventor: Alan E. Freedman, 11 Raven Rd., Canton, Mass. 02021

[21] Appl. No.: 388,677

[22] Filed: Aug. 2, 1989

[51] Int. Cl.[5] ..... A47K 3/22

[52] U.S. Cl. ..... 4/597; 4/615; 239/569; 239/576

[58] Field of Search ..... 251/4, 295; 4/596, 597, 4/602, 603, 615, 616, 617, 618; 239/569, 576, 578

[56] References Cited

U.S. PATENT DOCUMENTS

| | | | |
|---|---|---|---|
| 1,998,222 | 4/1935 | Conklin | 251/295 |
| 2,042,278 | 5/1936 | Sloan | 251/295 |
| 4,539,720 | 9/1985 | Westerweller | 4/616 |
| 4,729,135 | 3/1988 | Titterington | 239/578 |

FOREIGN PATENT DOCUMENTS

| | | | |
|---|---|---|---|
| 538483 | 6/1955 | Belgium | 251/295 |
| 2425223 | 1/1980 | France | 4/602 |
| 945645 | 1/1964 | United Kingdom | 251/295 |

*Primary Examiner*—Andres Kashnikow
*Assistant Examiner*—Christopher G. Trainor
*Attorney, Agent, or Firm*—Wolf, Greenfield & Sacks

[57] ABSTRACT

A shower apparatus for controlling water that is being expelled from a showerhead under pressure. A water conduit couples from a pressurized water pipe adjacent to the showerhead and connects to a mat which the user steps upon. The water conduit includes a mat conduit which the user steps upon. The water conduit includes a mat conduit having an actuating or switching means operable by foot pressure from the user to selectively restrict water flow at the showerhead.

6 Claims, 3 Drawing Sheets

SHOWER HEAD

BACKGROUND OF THE INVENTION

1. Field of the Invention

The present invention relates in general to a shower apparatus and pertains, more particularly, to a flow control apparatus for controlling water issuing from a showerhead to thereby conserve water by reducing the amount of water required to take a shower. Even more particularly, the present invention relates to a flow control apparatus that permits dispensing of water from a showerhead and which can be operated preferably by foot to selectively interrupt water delivered from the showerhead.

2. Background Discussion

The following are representative patents showing various forms of shower apparatus including associated controls;

| | | |
|---|---|---|
| R. Trubert | 2,839,264 | June 17, 1958 |
| E. Ternullo | 3,188,011 | June 8, 1965 |
| W. Coons | 3,293,664 | Dec. 27, 1966 |
| Downey | 3,657,746 | Apr. 25, 1972 |
| Titterington | 4,729,135 | Mar. 8, 1988 |

In the above noted patents, and in particular in a patent such as the one to Titterington, namely U.S. Pat. No. 4,729,135, it is noted that, as part of the shower apparatus control, there is included a valve for controlling liquid flow. Generally speaking all of the above mentioned patents show fluid lines primarily for the purpose of actuating a valve.

One of the problems associated with these types of arrangements is that the valve is one that is generally electrically operated and thus there are certain dangers associated with the use of any electrical apparatus particularly in a water environment.

Also, many of the arrangements illustrated in the prior art patents are relatively complicated in construction and are thus impractical as they are relatively costly from a manufacturing standpoint.

Accordingly, it is an object of the present invention to provide an improved shower apparatus and in particular an improved flow control apparatus associated therewith and one in which there is no requirement for an actuating valve for water control.

Another object of the present invention is to provide an improved and simplified flow control technique for use in a showerhead to permit selective conservation of water flow.

A further object of the present invention is to provide an improved flow control device for a shower apparatus and in which the user of the shower apparatus can control a water flow from the shower head by particular positioning on a mat in the shower whereby one position on the mat the water is permitted to be dispensed from the waterhead while in the other position thereof the dispensing is interrupted.

SUMMARY OF THE INVENTION

To accomplish the foregoing and other objects, features and advantages of the invention there is provided a shower apparatus that is adapted for controlling water that is expelled from a shower head. The showerhead is not connected directly to the pressurized water source but instead is coupled by way of a water conduit that is adapted to receive the pressurized water. This water conduit includes an inlet conduit and an outlet conduit. The inlet and outlet conduit both couple to a mat upon which the user steps. The mat is positioned under the showerhead. Means are provided for connecting the inlet conduit from the pressurized source to the mat. Means are also provided for the connecting the outlet conduit from the mat to the showerhead. The mat includes means for selectively restricting water flow between the inlet and outlet conduits in response to foot pressure from the user.

In a preferred embodiment of the present invention disclosed in further detail here and after, the inlet and outlet conduits are adapted for physically coupling in parallel between the showerhead area and the mat. Thus, the inlet conduit actually connects to the pressurized water source and directly adjacent to the showerhead but to the rear thereof.

In accordance with the present invention in a preferred embodiment disclose herein, the water conduit may be in a single piece construction in which the inlet and outlet conduits are extending in a continuous manner through the mat. The means for selectively restricting water flow between the inlet and outlet conduits in the preferred embodiment is in th form of a hose or conduit section that can be pinched off by application of foot pressure by user. In one embodiment disclosed herein, there is a form of serpentine loop that can be stepped on various sections on the mat preferably at positions of the mat are more remote from the showerhead.

In accordance with the mode of operation and accordance with the present invention, the mat may be considered as one separate into two different segments, one closer to the showerhead and one more remote from the showerhead. When the user is stepping on the section of the mat closer to the showerhead there is no interruption in the water flow from the showerhead. On the other hand, when the user steps rearwardly away from the showerhead then the conduit is pinched off and the water flow is interrupted. In this way water can be conserved when one is not directly under the showerhead. The water is simply interrupted in its flow.

BRIEF DESCRIPTION OF THE DRAWINGS

Numerous other objects, features and advantages of the invention should now become apparent upon the reading of the following detailed description taken in conjunction with the accompaning drawings, in which.

DETAILED DESCRIPTION

Reference is now made to the drawings herein for an illustration of certain embodiments of the present invention. The invention relates generally to the conservation of water used in a shower. For this purpose there is provided a mat that one can step on in the shower to interrup water flow to the showerhead. In this connection the mat is relatively rather flat and has an area more closely adjacent to the showerhead which permits water to be expelled from the showerhead as well as an area more remote from the showerhead. In the more remote area when the user steps on the area or selected portions thereof, the water is shut off at the showerhead.

With the arrangement of the present invention when one is on the front part of the mat the water would be coming out of the shower, but as soon as one stepped to the rear part of the mat, then the water being coupled through the mat would essentially be pinched off and there would not be any water coming out of the showerhead. In this way one conserves water.

In a preferred embodiment of the invention a water conduit or hose is employed coupled from the pressurized water supply adjacent to the shower head down to the mat, through the rear portion of the mat and then back up again to the showerhead in essentially a series of water circuit.

Figure 5:
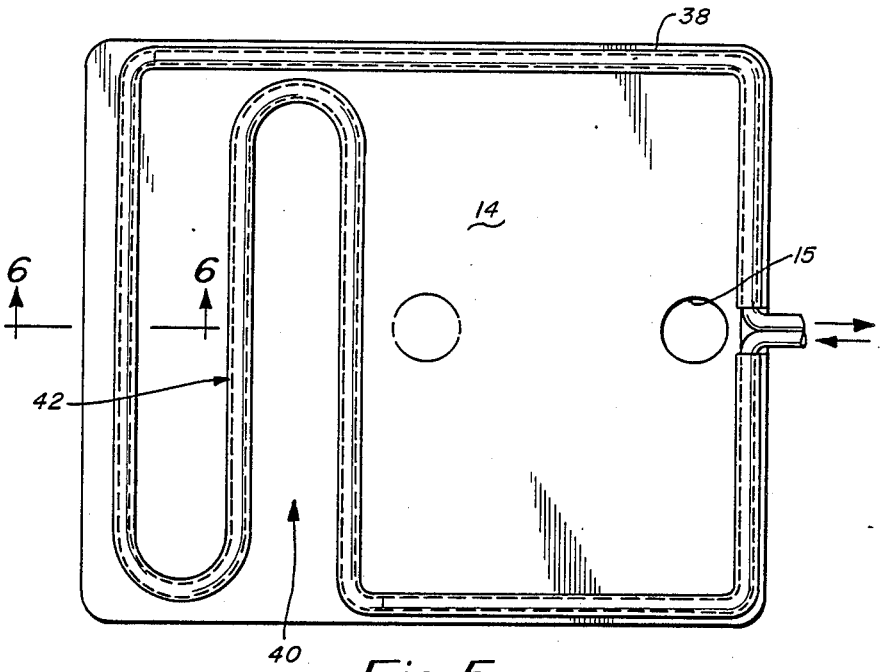
FIG. 5 is a plan view of an alternate form of a mat construction in accordance with the present invention and FIG; 6 is a cross sectional view taken along the line of 6—6 of FIG. 5.
Figure 6:
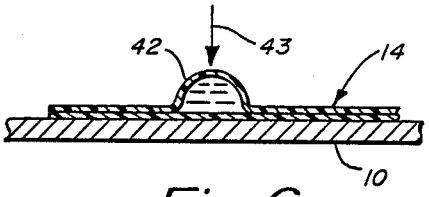

References now made more particularly to the drawings herein. A first embodiment of the invention is illustrated in FIGS. 1–4. An alternate embodiment of the invention is illustrated in FIGS. 5 and 6. Like reference characters will be applied throughout the drawings when appropriate.

Figure 1:
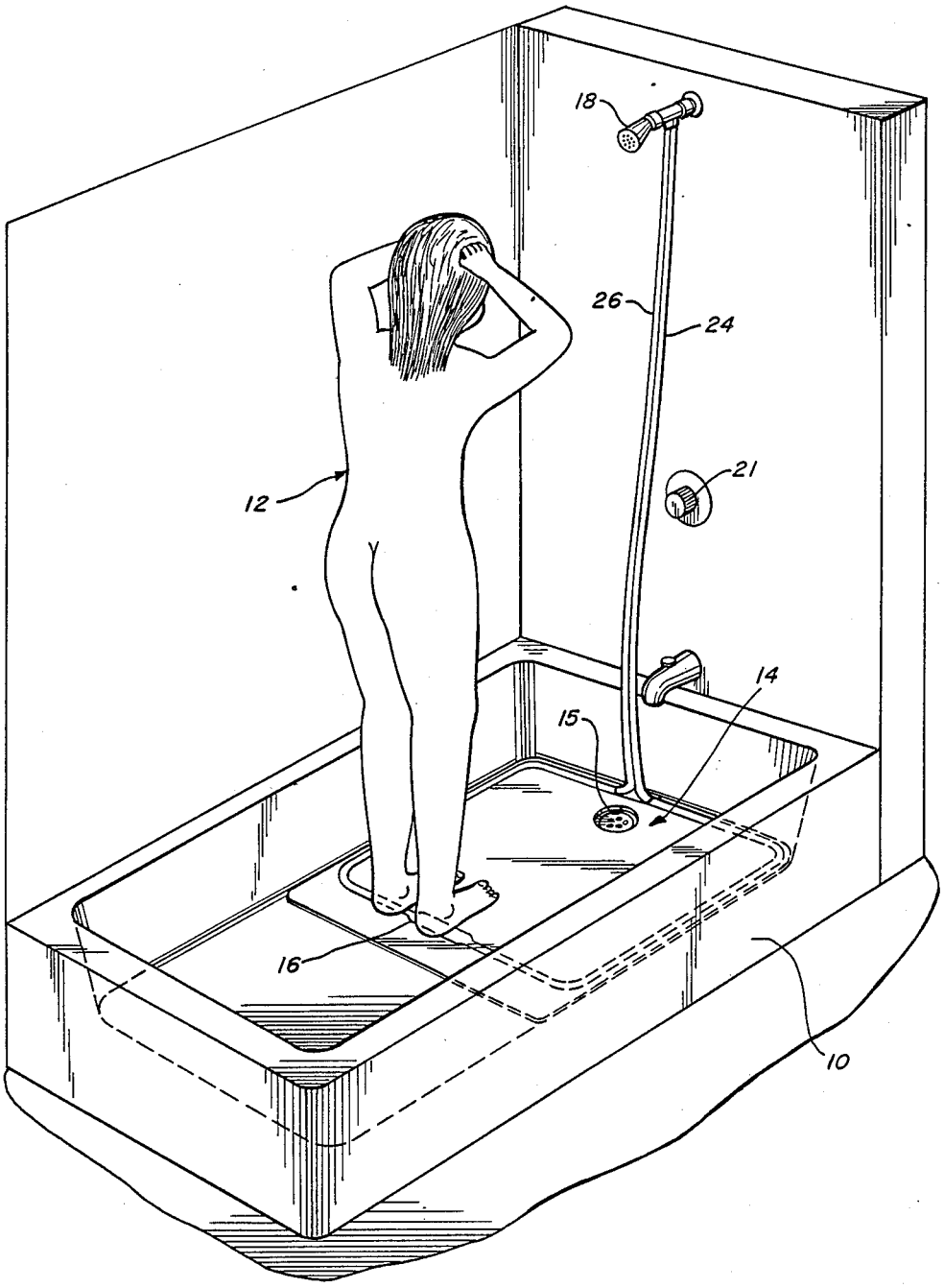
FIG. 1 is a perspective view of the shower apparatus of the present invention.

FIG. 1 shows a bathtub 10 having the user 12 standing therein. The user 12 is standing upon the mat 14 which comprises a part of the control apparatus of the present invention. It is note in FIG. 1 the mat 14 is substantially flat and at its forward portion has a whole 15 that is in alignment with the drain in the tub 10. The mat 14 may be constructed of a light weight but durable rubber material and may include some type of a foam core. In the embodiment of FIG. 1 at the rear portion of the mat 14 there is provided an actuating means or switch means generally illustrated at 16. This is foot-actuated by user 12 such as is illustrated in FIG. 1. When the user steps upon this actuating or switching means then the water flow out of the showerhead 18 is interrupted.

Figure 2:
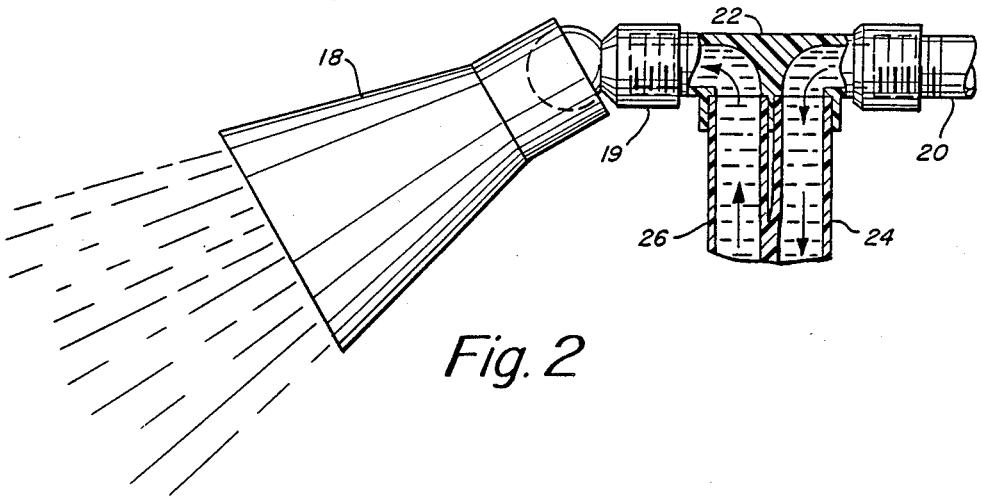
FIG. 2 is a fragmentary cross sectional view of a portion of the shower apparatus of the present invention particularly in the area of the showerhead
Figure 3:
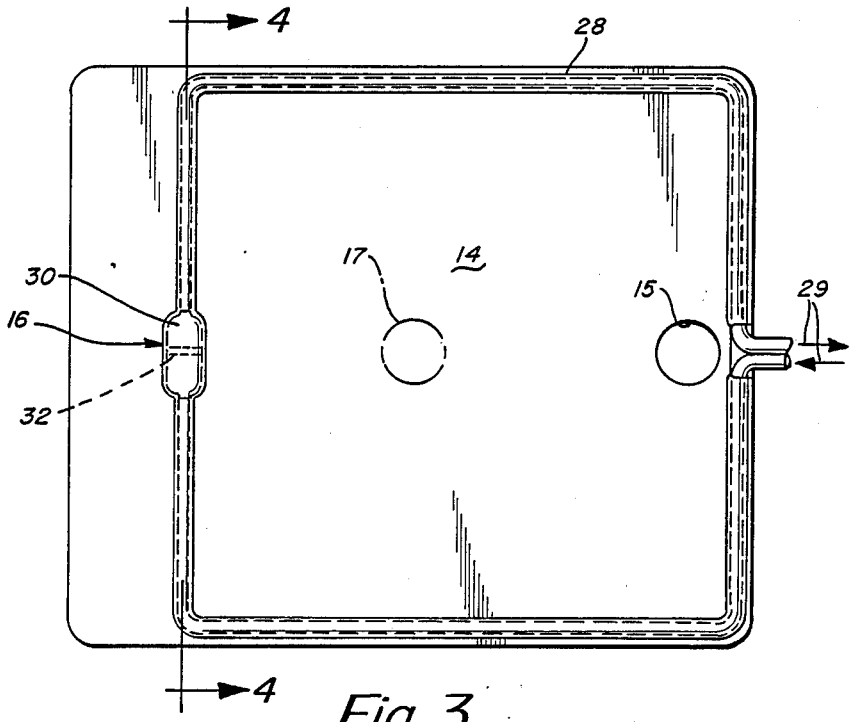
FIG. 3 is a plan view for one embodiment of the mat.
Figure 4:
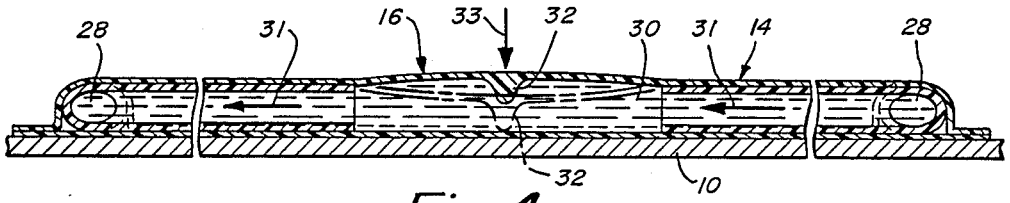
FIG. 4 is a cross sectional view taken long line 4—4 of FIG. 3.

Now, with respect to the water circuit, a reference may be made to FIGS. 1–4 and in particular FIGS. 1 and 2. It should also be noted that the particular apparatus of the present invention is readily adaptable to an existing showerhead plumbing construction. In this connection, in FIG. 2, for example, the showerhead 18 with its fitting 19 may simply be removed from the normal showerhead water pipe 20. The adapter of the present invention as illustrated in FIG. 2 is then interposed between the waterpipe 20 and a coupling 19. This includes a fitting 22 that intracouples between waterpipe 20 and coupling 19. Attached to the FIGS. 15–22 is a water conduit means including an inlet conduit 24 and an outlet conduit 26. Thus, it can be seen from the cross sectional view of FIG. 2 of that the water from the pressurized source coupling by way of the waterpipe 20 does not couple directly through the showerhead but instead couples down the conduit 24 to the mat. Within the mat the conduit is continuous as illustrated by the mat conduit 28 coupling through the mat. Refer to FIG. 3. It is noted that arrows 29 in FIG. 3 also illustrate the direction of water flow through the mat conduit 28. The series water circuit thus progresses down the inlet conduit 24 continuously through the mat conduit 28 and back out the outlet conduit 26 when the water may be expelled from the showerhead 18.

Referring to FIG. 3 , an alternate hole placement is also illustrated. FIG. 3 illustrates the hole 15 that would be used with the tub arrangement of FIG. 1. In addition, there may also be provided a second hole 17 that would be more adaptable to the placement of a drain in a normal (stall) shower.

Now, as long as one is stepping on the main forward or central portion of the mat 14 the water is permitted to flow through the aforementioned conduits to the showerhead 18. This presupposes that the water is turned on at the control knob 21 illustrated in FIG. 1.

When one wishes to interrupt a water flow, such as for the purpose of applying shampoo to the hair and in an effort to conserve water, one steps on the actuating mean 16 as previously illustrated in FIG. 1. In this regard FIGS. 3 and 4 show further details of the actuating means 16. This includes a small chamber 30 that has extending into it a tab 32. When foot pressure is applied in the direction of the arrow 33 in FIG. 4 then the tab 33 moves to the position illustrated in phantom outline in FIG. 4 and essentially interupts water flow through the mat conduit 28. After the user is through shampooing the hair, for example, the user can simply step off the actuating means 16. Tab 32 then resiliantly returns to the "insolid" position illustrated in FIG. 4 and water is able to flow through the mat conduit as illustrated by the direction of arrows 31 in FIG. 4.

Reference is now made to FIGS. 5 and 6 for an alternate embodiment of the invention. In FIGS. 5 and 6 rather than having a single area for actuation, the mat conduit 38 takes on a somewhat different configuration including the rear portion 40 of the mat. A serpentine conduit section 42 that has a few terms therein. Two separate terms are illustrated in FIG. 5, however, it is noted that several different terms may be employed to properly cover the rear area 40.

The conduit 42 is constructed to be relatively pliable and thus one can step on any segment thereof such as indicated by the arrow 43 in FIG. 6. Thus, by foot pressure the section 42 of the water conduit can be interrupted virtually at any place there along to interrupt a water flow while using the shower.

Having now described a limited number of embodiments of the present invention, numerous other embodiments and modifications thereof are contemplated as falling within the scope of the present invention as defined by the dependent claims.

What is claimed is:

1. A shower apparatus for controlling water that is being expelled from a showerhead under pressure, said apparatus comprising, a water conduit means adapted to receive the pressurized water and including an inlet conduit and an outlet conduit, a mat upon which the user steps and positioned under the showerhead, means connecting the inlet conduit from the pressurized source to the mat, means connecting the outlet conduit from the mat to the showerhead, said mat including means for selectively restricting water flow between the inlet and outlet conduits in response to foot pressure from the user, and wherein said means for selectively restricting water flow includes a flexible mat conduit.

2. A shower apparatus as set forth in claim 1 including a fitting intercoupling an input waterpipe and the showerhead and having respective part for receiving said inlet and outlet conduits.

3. A shower apparatus as set forth in claim 2 wherein said means for selectively restricting water flow further includes an actuating member having a tab so that when foot pressure is applied thereto water flow is interrupted in the mat conduit.

4. A shower apparatus as set forth in claim 2 wherein said mat conduit includes a serpentine length of water conduit having a flexability so that the conduit can be pinched off by application of foot pressure.

5. A shower apparatus as set forth in claim 2 wherein the means for selectively restricting water flow is disposed at a position on the mat more remote from the showerhead.

6. A shower apparatus set forth in claim 2 wherein the mat is substantially flat and is constructed of a light weight rubber material.

* * * * *